United States Patent [19]

Lambert

[11] Patent Number: 4,506,930

[45] Date of Patent: Mar. 26, 1985

[54] WHEEL-CHAIR ADAPTED TO ENABLE THE PATIENT TO STAND UP

[75] Inventor: Jean-Pierre Lambert, Saint-Cyr-sur-Loire, France

[73] Assignee: Etablissements Poirier, France

[21] Appl. No.: 348,412

[22] Filed: Feb. 12, 1982

[30] Foreign Application Priority Data

Feb. 23, 1981 [FR] France ..... 81 03546

[51] Int. Cl.[3] ..... A61G 5/00

[52] U.S. Cl. ..... 297/423; 297/429; 297/DIG. 4; 297/DIG. 10

[58] Field of Search ..... 297/423, 429, DIG. 4, 297/DIG. 10

[56] References Cited

U.S. PATENT DOCUMENTS

| | | | |
|---|---|---|---|
| 3,023,048 | 2/1962 | Barton | 297/DIG. 4 |
| 3,139,306 | 6/1964 | Jennings | 297/423 X |
| 3,398,974 | 8/1968 | Edwards et al. . | |
| 3,640,566 | 2/1972 | Hodge | 297/DIG. 10 |
| 3,787,089 | 1/1974 | Wrethander | 297/DIG. 10 X |
| 4,076,304 | 2/1978 | Deucher | 297/DIG. 10 X |

*Primary Examiner*—William E. Lyddane
*Assistant Examiner*—Peter R. Brown
*Attorney, Agent, or Firm*—Poms, Smith, Lande & Rose

[57] ABSTRACT

The present invention relates to a wheelchair which enables the patient to stand up and be supported laterally, forwardly, and rearwardly, and consists of a conventional frame resting on the ground by means of displacement members and supporting a seat. Said wheelchair has a movable structure, with two independent frames which extend parallel to the sides of the wheelchair, one frame on each side of said chair, and which are mounted for pivoting on the said conventional frame about horizontal transverse axes which permit their forward pivoting movement over substantially 90° during which a set of bars pivotally mounted to said independent frames is moved from a first position of the structure, at the back of the seat, to a second position of the structure, in the free space at the front of the said seat.

9 Claims, 9 Drawing Figures

14
31
64
37
36
65
66
32
2
33
30
27
T
60
38
3a
28
59
3
4
17
19
40
21
1
47
16
7

WHEEL-CHAIR ADAPTED TO ENABLE THE PATIENT TO STAND UP

The present invention relates to a wheel-chair which enables the patient to stand up.

Wheel chairs are already known, which are especially used for paraplegic patients, and which enable the patient to stand up.

It is indeed a recognized fact today that it is necessary for multiple reasons—and in particular physiological and psychological ones—to enable a handicapped person to stand up to a vertical position during the day. This operation which many specialists call "uprighting", has been essentially developed with the help of fixed installations giving the handicapped person the facilities of standing up. Certain wheel-chairs have a movable seat and backrest, which also enable the patient to stand up.

The object of the present invention is to propose a new way to equip a wheel-chair, which makes it possible for the handicapped person to stand up.

The object of the present invention is therefore a wheel-chair which gives the patient a possibility to stand up and which is especially designed for a paraplegic patient, comprising a conventional frame resting on the ground by means of forward and backward displacement members and supporting a seat, and a movable structure which is separate from the seat and is adapted to occupy the two following positions: a first position, in which the said structure is retracted so as, on the one hand, to leave free at least the space at the front of the seat, whilst maintaining the rolling possibilities of the wheel-chair, and, a second position, in which the said structure, on the one hand, is set in the free space situated in front of the seat whilst remaining accessible to the hands of the user sitting in the wheel-chair, and on the other hand, rests on the part of ground situated at the front of the seat.

The said structure comprises two frames which extend substantially parallel to the sides of the wheel-chair, one frame on each side of said chair, and which are mounted for pivoting on the said conventional frame about horizontal transverse axes which permit their forward pivoting movement over substantially 90° during which a set of bars is moved from a first position of the structure, behind a backrest to a second position of the structure, in the free space at the front of the said seat.

The following advantageous dispositions are also preferably adopted:

in its first position, the structure occupies the same space volume laterally, on each side of the seat and within the space situated above the seat, which is substantially equal to the space occupied by the frame of a conventional wheel-chair;

the wheel-chair comprises a foot-rest, which is mounted on the frame, and can occupy two positions, corresponding to the folling possibilities of the wheel-chair, in which said foot-rest is above the ground, without being in contact therewith, and the other, which corresponds to the said second position of the structure, in which said foot-rest is resting firmly on the ground and raises the front moving members of the chair, whereas said two frames in said second position of the structure, are resting on said foot-rest;

a locking device enables to lock the foot-rest in its position resting on the ground;

another locking device produces, in the said second position of the structure, the junction of the two frames on the foot-rest;

the structure comprises a knee-rest which is at least partly removable and which, in the second position of the structure, extends crosswise horizontally, at the level of the knees of a patient using the chair;

the structure comprises a movable element which, in the second position of said structure, is adapted to be placed crosswise horizontally, substantially close to the vertical plane traversing the front edge of the seat, whilst being situated at a height which is at least equal to that of the pelvis of a patient standing up on the foot-rest of the wheel-chair, and which is separate from the seat of said chair, the said seat having a fixed position with respect to the frame in the first and second positions of the structure;

in the second position of the structure, the two frames are joined together by a dismountable rigid element which, in that second position, is placed transversely and horizontally and ensures the rigidification of said structure;

the said rigid element, in the second position of the structure, extends substantially level with the trunk of a patient sitting in the chair;

each frame is held in a pivoting position about its axle by an instantly-mounted and dismounted device.

The invention will be more readily understood on reading the following description with reference to the accompanying drawings in which.

Figure 1:
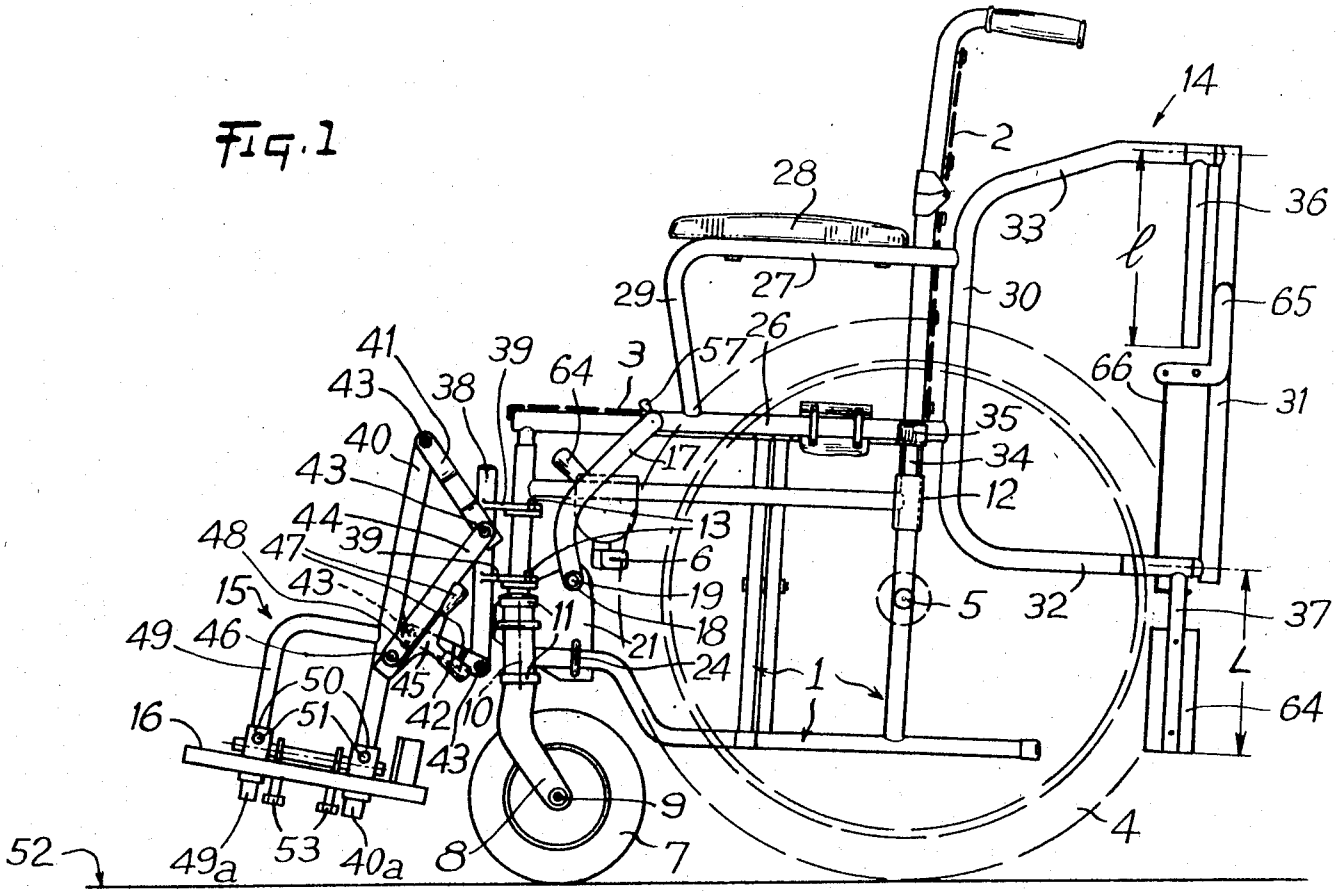
FIG. 1 is an elevational view of a first configuration of a wheel-chair according to the invention.

The wheel-chair according to the invention is composed of a conventional frame consisting of:

a lower support 1, which may be foldable, but which is rigid in the illustrated example, a back-rest 2 which, in the illustrated example is fixed with respect to the support 1;

a seat 3, two large back wheels 4, rotating about horizontal axles 5, and each one provided with a brake 6, two small front wheels 7, mounted for rotating on forks 8 about horizontal axles 9, the said forks being themselves mounted for rotating on the support 1 about vertical axles 10 by means of bearings 11.

In equally known manner, a section 12 of hollow cylindrical tube is welded to the back of the support 1, on each side of the seat 3, and allows the introduction of the socket of a removable arm-rest. Close to the transverse plane containing the axles 10 are placed two vertical lugs 13, which lugs are secured to the support 1 and facing upwards, said lugs permitting the hooking on of the frame of a foot-rest, and to fit said foot-rest for pivoting about vertical lugs 13 (one foot-rest being mounted on each upright side member at the front of the support 1).

The devices proposed by the invention are adapted to be fitted on the known frame. They essentially consist, on each side of the vertical plane of symmetry P of the wheel-chair, in placing:

a movable structure 14, which is generally plane and contained inside a vertical plane S situated between a large back wheel 4 and the adjacent edge of the seat 3, the hinged support 15 of a foot-rest 16.

Each structure 14 comprises an arm 17 whose end 18 is provided with a pivoting axle 19 extending perpendicularly to the plane S of the structure, and which can be mounted for rotating inside a bearing 20 integral with an adjusting plate 21. The end 22 of the axle 19 is grooved and enables to hold the axle 19 inside the bearing 20 in cooperation with a circlip 23. Each adjustment plate 21 is secured (24) on the support near each bearing 11, and then extends in parallel to the plane S. In this position of the adjustment plate 21, the axle 25 of the bearing 20 is transversal horizontal and coincides with the geometrical pivoting axis of axle 19. Thus, the structure 14 is mounted for pivoting inside the plane S which is fixed with respect to the support 1. Each structure 14 can thus pivot about the corresponding pivoting axle 19 and occupy two very different positions, that of FIG. 1 and that of FIG. 2. This structure, in order to be defined, is first described with reference to the first position shown in FIG. 1.

In said first position, the structure 14 comprises:

a first rigid frame constituted by a quadrilateral with two horizontal bars, a lower bar 26 and an upper bar 27 said latter supporting an arm-rest 28; two vertical bars, at the front 29 and at the back 30, complete the quadrilateral;

a second equally rigid frame, constituted by an extension of the vertical back bar 30, of the first frame, another vertical bar 31 situated at the back of the bar 30, a lower horizontal bar 32 and an upper bar 33 slightly oblique with respect to the horizontal, reaching the back of the horizontal upper bar 27 of the first frame, and therefore the back of the arm-rest 28.

A small cylindrical support 34 is introduced in the section of tube 12 and carries at its upper part a U-shaped piece 35, between the branches of which rests the back part of the lower horizontal bar 26 of the first frame. The bar 26 is substantially situated at the same height as the seat 3, and the first frame occupies, in the end, substantially the same place as the frame of a normal arm-rest. On the contrary, the second frame 30-31-32-33 is entirely placed at the back of the back-rest 2, so as to give no discomfort to the patient and is substantially contained within the maximum volume space of a conventional wheel-chair.

Another fact to be noted is the presence of two bars 36 and 37 which are mounted for pivoting, one 36, about the axle of the upper bar 33 of the second frame, substantially in the area where the bars 31 and 33 are joined together, the other bar 37 about the axle of the lower bar 32, close to where the bars 32 and 31 join up. In the illustrated embodiment, there is a bar 36 and a bar 37 for each structure 14, but each bar 37 is provided at its end with a cushion 64 and controlled by a lever 65. The respective lengths l and L of the bars 36 and 37 will be specified hereinafter.

Figure 2:
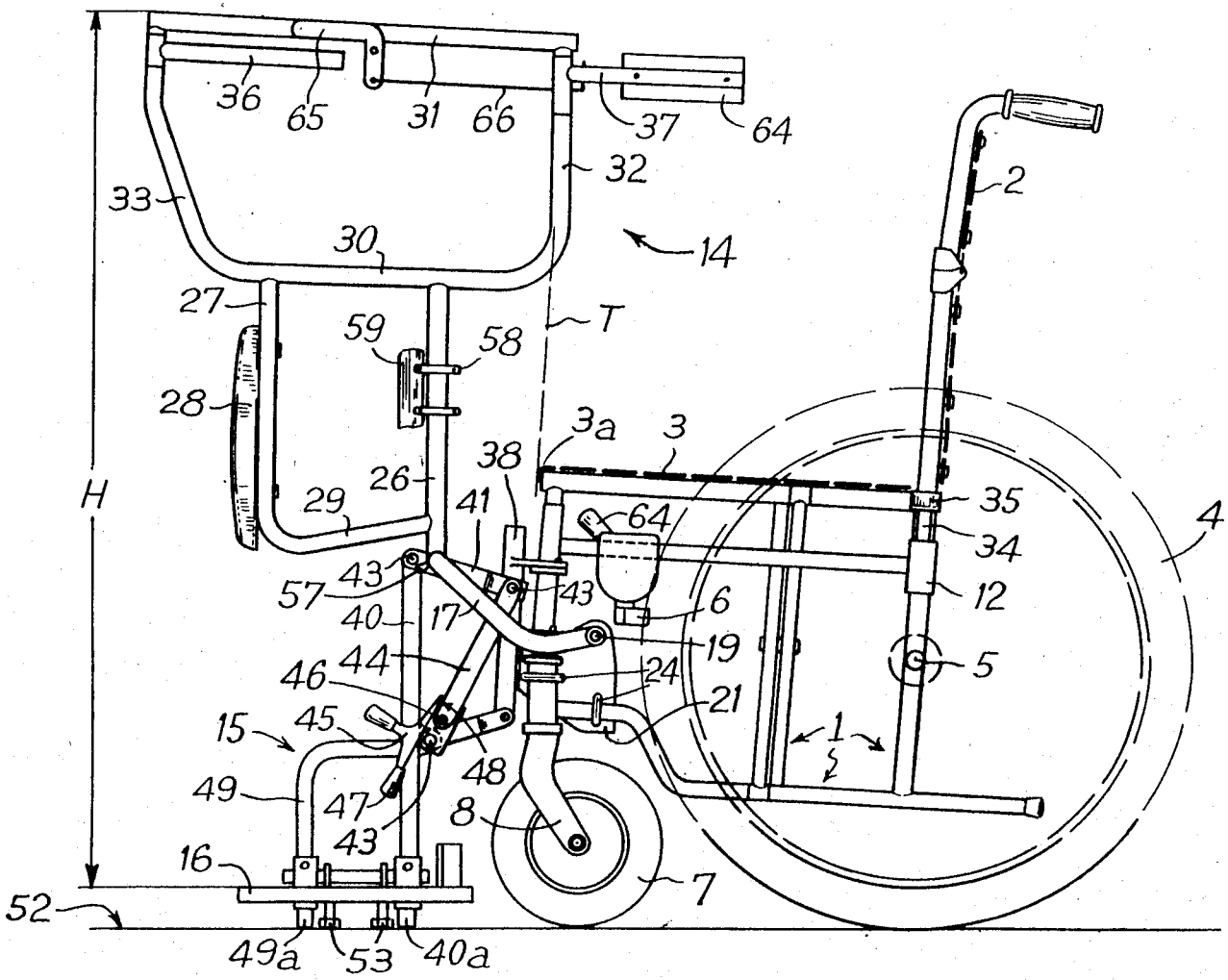
FIG. 2 is an elevational view of an enlarged detail of a second configuration of the wheel-chair of FIG. 1.

The support 15 of a foot-rest comprises:

a vertical bar 38, provided with spaced apart lugs 39 permitting the pivoting assembly of said bar on the lower support 1 by way of the vertical lugs 13, another bar 40 of variable inclination, close to the vertical, placed in front of the bar 38 and connected thereto by two connecting bars 41, 42 mounted for pivoting about axes 43, the bars 38, 40, 41 and 42 constituting a deformable quadrilateral, a diagonal bar 44 mounted for pivoting, on the one hand, about one of the axes 43, apices of the said quadrilateral, and on the other hand on a pivoting bracket 45, about an axle 46, said bracket 45 being mounted for pivoting on the bar 40 about axle 43 opposite the first pivoting axle 43 of the diagonal bar 44, two levers 47 controlling the pivoting movement of the bracket, said pivoting movement enabling a slight vertical displacement of the axle 46, an abutment 48 provided on the bracket 45 and which is adapted to come in resting contact on the diagonal bar 44 and to lock same in the position shown in FIG. 2.

at last bar 49 which is L-shaped and welded by one of its branches, to the bar 40, its other branch extending downwardly, parallel to said bar 40.

Collars 50 to which the foot-rest 16 is secured, are mounted for sliding on the bars 40 and 49 and are provided with a lock-screw 51 which is positioned with respect to the said bars, and controlling the distance separating the foot-rest from the ground 52. The lower ends **40*a* and 49*a* of the bars 40 and 49 constitute the feet of the support 15 in contact with the ground, and, depending on the pivoting movement of the bracket 45, are either off the ground 52 (FIG. 1), or firmly resting on the ground 52 (FIG. 2) raising even slightly the support 1 (and the front wheel 7 coupled thereto) with respect to the ground. In this last configuration, the abutment 48 is effectively resting on the diagonal bar 44, this rigidifying the quadrilateral of the bars 38, 40, 41, 42. Moreover, each foot-rest is provided with lower screws 53 enabling it to rest directly on the ground 52**.

It will be noted that the brake 6 is applied on the back wheels 4 in the configurations shown in FIGS. 1 and 2, and that, as a result, the wheel-chair is already immobilized.

In the configuration of FIG. 2, each movable structure 14 has been pivoted about its axle 19 over about 90°. The bars of the second frame have come, respectively:

the bar 31, horizontal, at a distance H from the foot-rest 16 which corresponds to the normal position where the hand and fore-arm of the patient standing on the foot-rest (FIG. 5) are leaning on said bar, the bar 32, substantially vertical, close to the vertical transverse plane T traversing the front edge **3*a* of the seat 3, the bar 33, substantially vertical, at the front of the bar 32**.

Figure 8:
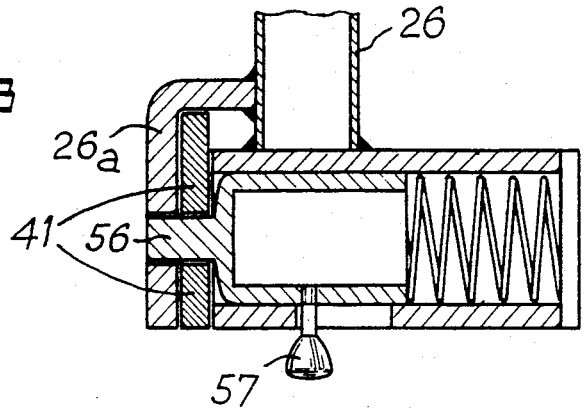

The arm-rest 28 is vertical when in the position where it is not used as an arm-rest. As already indicated, the foot-rest support is resting on the ground 52 by the ends **40*a* and 49*a* of two of its bars, and it must be noted that the bar 26 of the first frame of the structure 14 is itself in resting contact on the bar 41 of the support 15 of the foot-rest, and is kept in that position by a locking member 56 provided with a control knob 57 (as shown in FIG. 8). A corner piece 26*a*, parallel to the end of the bar 26**, reinforces this locked support.

Thus, in this second position of the foot-rest 16 and of the pivoting structure 14, a rigid assembly 15-16-14 is firmly set on the ground 52.

Figure 3:
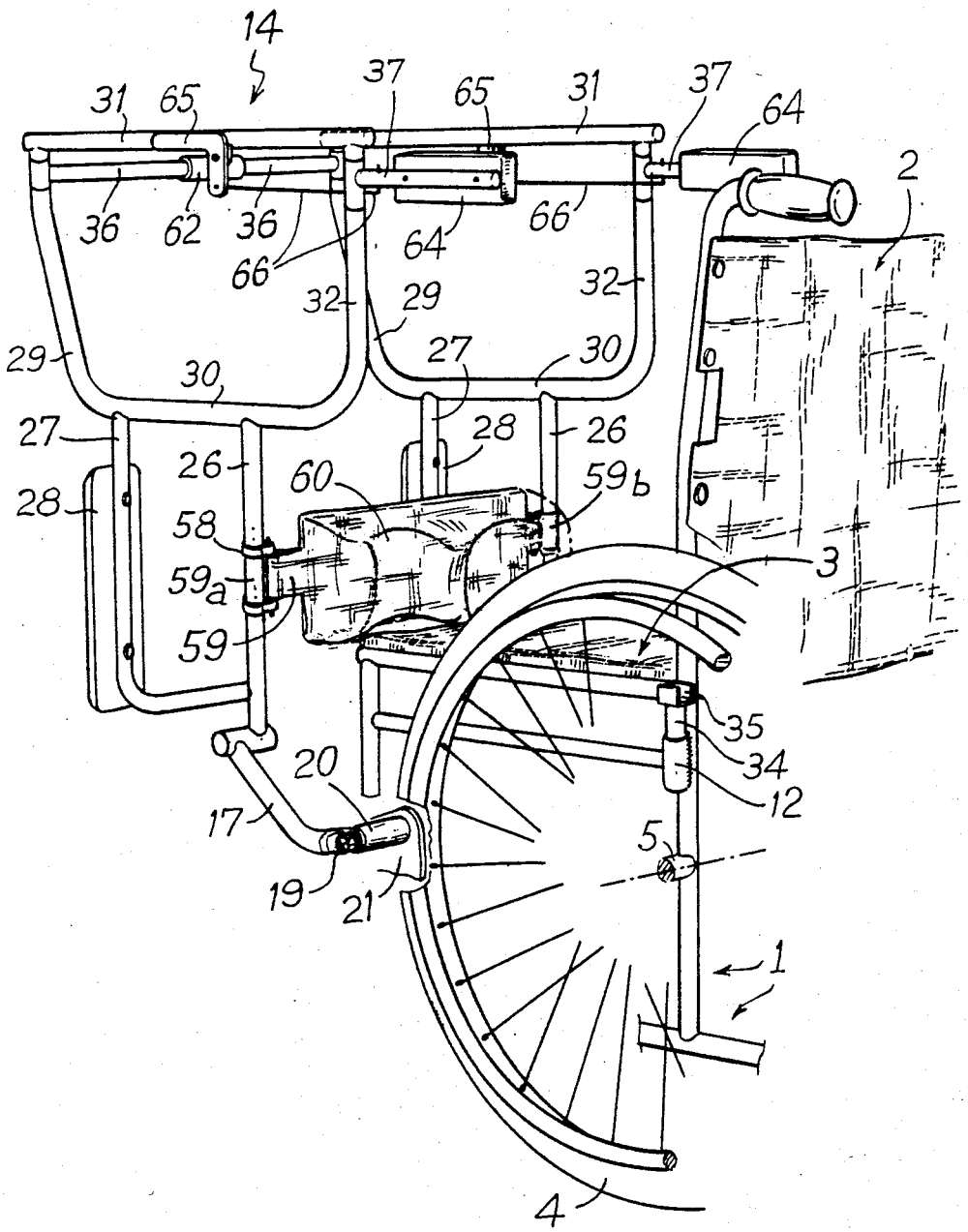
FIG. 3 is a perspective view of a third configuration of the wheel-chair of FIGS. 1 and 2.
Figure 4:
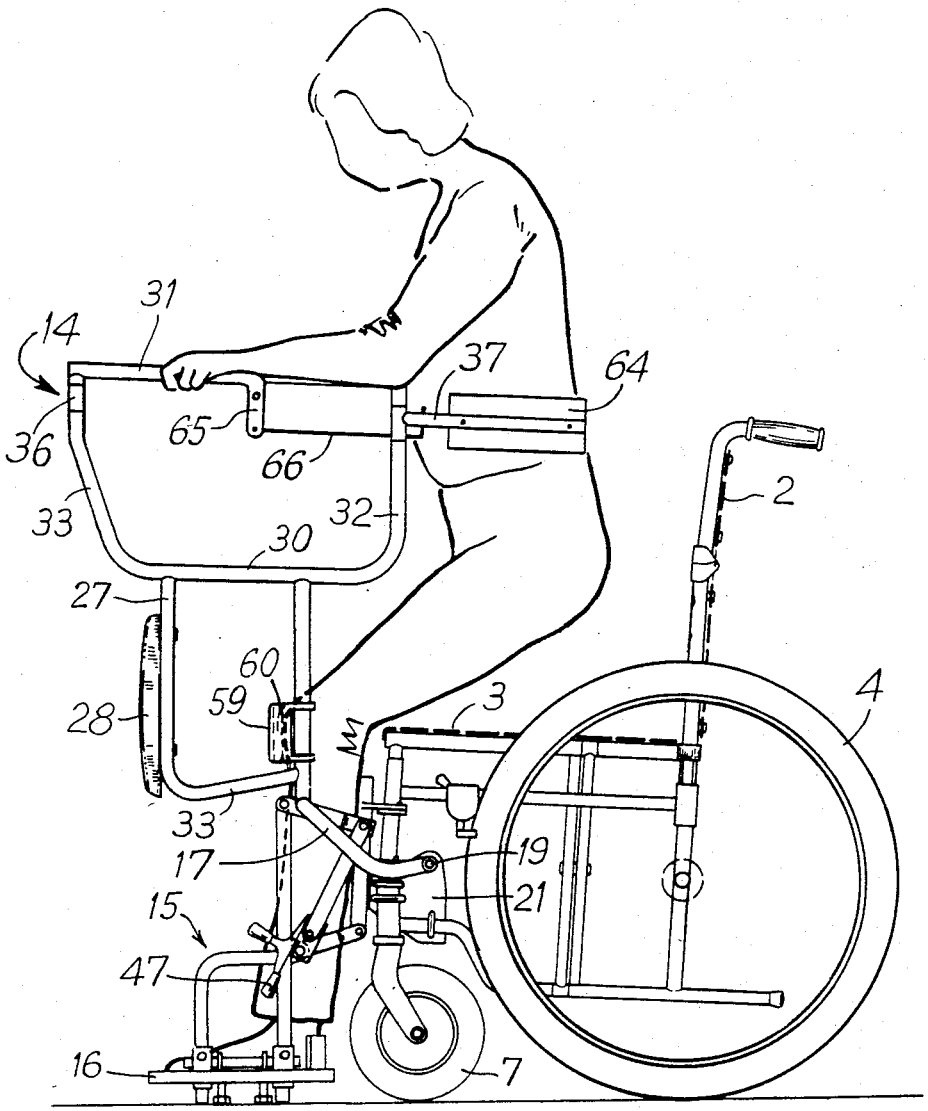
FIGS. 4 and 5 are elevational views explaining how the wheel-chair of FIGS. 1 to 3 works.
Figure 5:
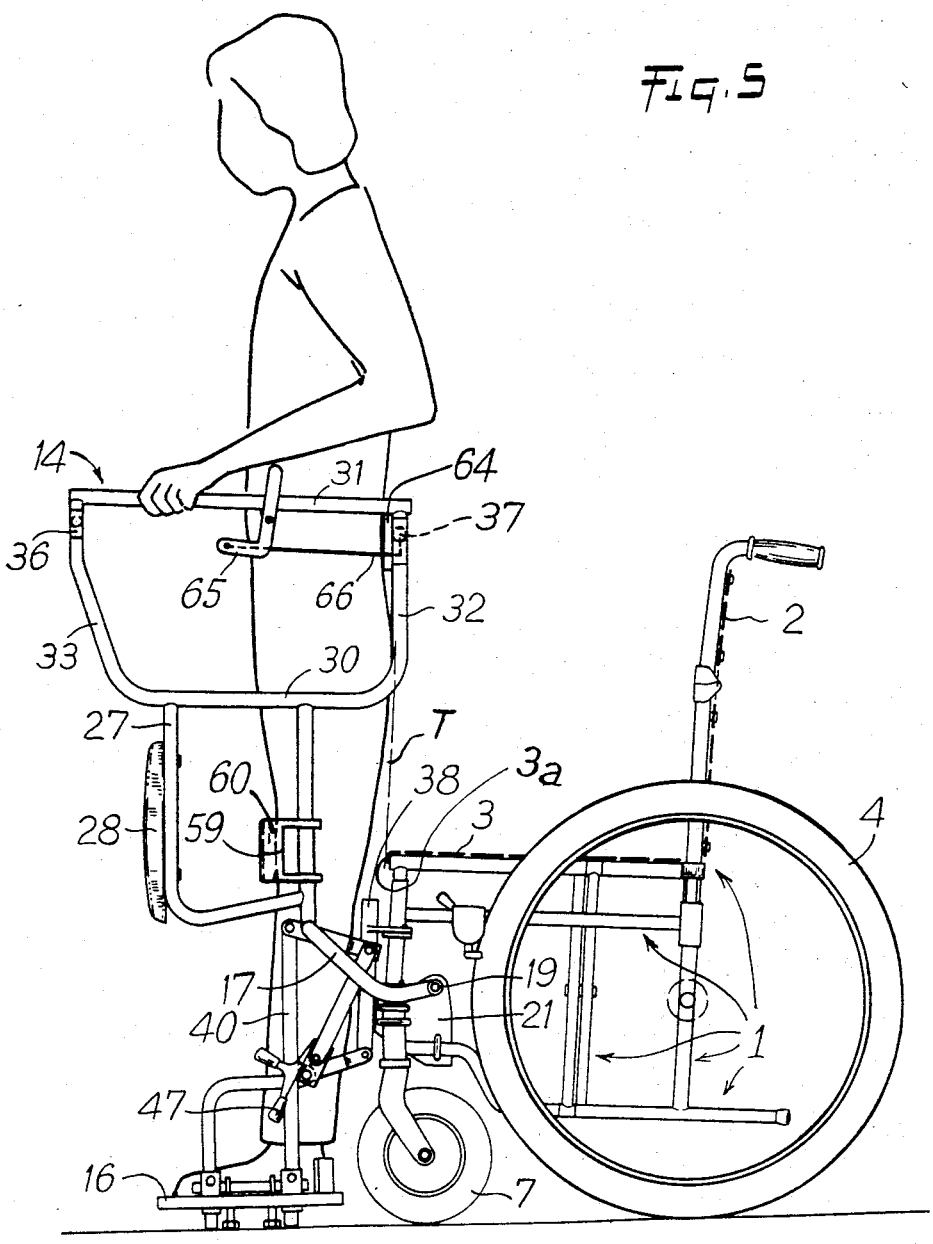

A collar 58 fixed at the middle of each bar 26 enables to fix a band of strong fabric 59 between the two bars 26, and this in removable manner, a first end **59*a* of the strip 59 being secured, permanently for example, on one of the bars 26, and, the other end 59*b* of said band 59** being fixed on the other bar 26 by a removable fastening member of the vehicle safety belt type. One of the faces of the band 59 is preferably covered with a strip of VELCRO permitting the instant fitting of an elongated cushion 60 substantially at the same height as the seat 3 and, in fact at the level of the knees of a patient installed in the wheel-chair (FIGS. 3, 4 and 5).

Figure 6:
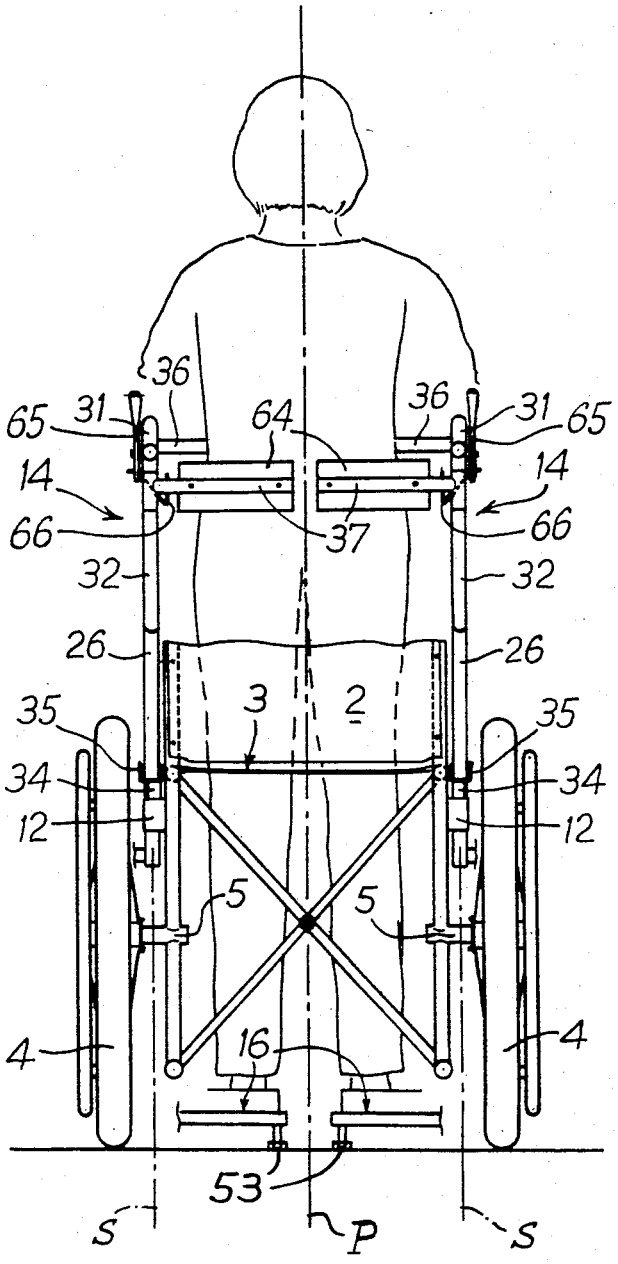
FIG. 6 is a back view of the wheel-chair shown in elevation in FIG. 5.
Figure 7:
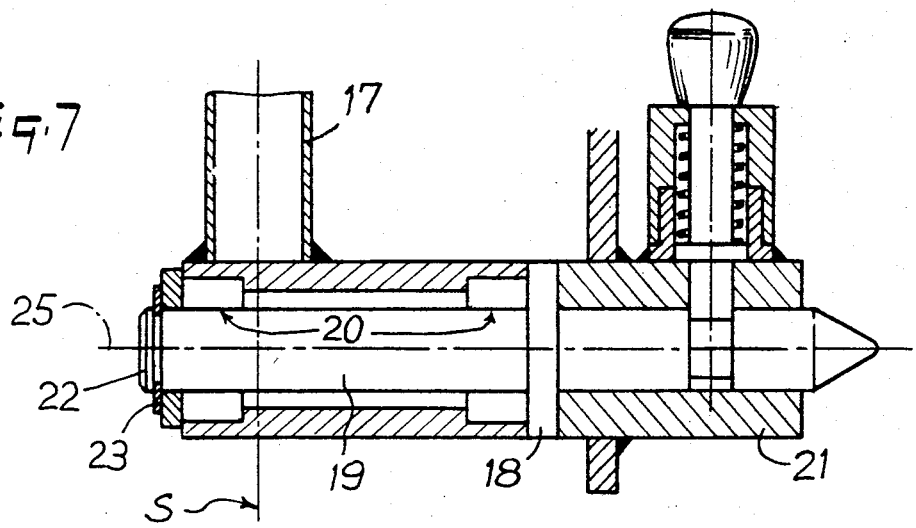
FIGS. 7, 8 and 9 are cross-sectional views of details of the said wheel-chair.
Figure 9:
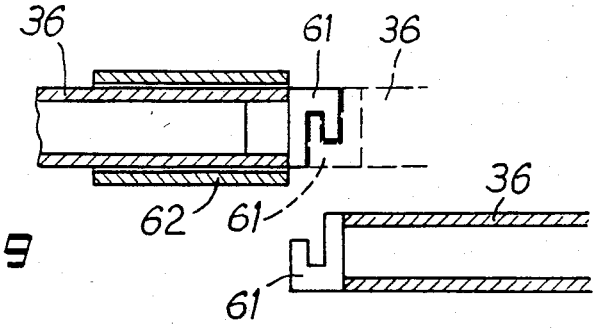

The new dispositon is used as follows:

The patient is sitting in the wheel-chair which is in its rolling position (FIG. 1). He immobilizes his wheel-chair by means of brakes 6 of the two back wheels 4. Then, he lowers his two foot-rests 16 by pivoting the levers 47 provided for controlling the position of the supports 15, and places said supports 15 and foot-rests 16 in the position shown in FIG. 2. He then causes each structure 14 to pivot about its axle 19, first by unlocking it (knob 57) from the support 1, and then by relocking it on the corresponding support 15 (FIG. 2). He places the band 59 between the bars 26 of the two structures 14 as well as the cushion 60. He is then in a position to pivot the two bars 36, whose length l corresponds to half the distance separating the two structures 14, and to insert the two ends thereof and to hold them in by a sliding sleeve 62 (FIGS. 3 and 9). Thus the two structures 14 are rigidified. He can then with his hands grip each structure 14 and, by pulling with his arms and simultaneously resting, on the one hand, his feet on the foot-rest 16, and, on the other hand, his knees on the cushion 60, stand up vertically (FIGS. 4 and 5). To avoid any accident, should the patient feel faint, the latter can, once he is standing up, cause the bars 37 to pivot by about 180°, to place them between the bars 32 of the two structures 14 (FIGS. 3 and 6), control and lock in position the bars 37 by means of the lever 65 which pivots about an axle of the bar 31 and of a connecting rod 66 connecting said lever to the bar 37 concerned. It is to be noted that the length L of each bar 37 is approximately equal to half the distance separating the two structures 14.

The patient, in the standing position, is thus surrounded laterally by each of the movable structures 14, at the front by the assembled bars 36, and at the back, by the bars 37, and can thus remain standing very safely.

It should also be noted that:

each structure 14, by pivoting between the positions of FIGS. 1 and 2, causes the lever 64 controlling the corresponding brake 6 to swing in the direction of braking, if this has not already been done, this implying the prior automatic immobilization of the wheel-chair before the positioning of the structures 14 as illustrated in FIG. 2;

in like manner, each structure 14 can only come to rest on the support 15 of the foot-rest when the bar 41 thereof is in the position shown in FIG. 2, i.e. in the position where the support 15 is resting firmly on the ground 52;

the structures 14 are put in the position illustrated in FIG. 2 by pivoting each one about its axle 19. This pivoting movement, parallel to the planes S and P requires no free space around the wheel-chair and can therefore be achieved even when the spaces all around the wheel-chair are not empty:

The very frame of the wheel-chair is unchanged with respect to a conventional wheel-chair and only two special parts, which in actual fact are easily and instantly removable have been added; the cylindrical supports 34, and the adjustment plates 21; this making the production of this new wheel-chair very economical;

when in the rolling position (FIG. 1), the overall structure of the wheel-chair is substantially identical to that of a conventional wheel-chair, and it is used exactly in the same way as a conventional wheel-chair: identical functions and positions of the foot-rests, arm-rests, seat and back-rest;

When standing up, the patient pulls on the structures 14 (FIG. 4) either on the bars 31, or even on the bars 36 which then ensure, not only a rigidifying connection between the two structures, but also the pulling support, enabling the user to straighten up.

The present invention is in no way limited to the description given hereinabove, but on the contrary covers any variants or modifications that can be brought thereto without departing from the scope or the spirit thereof.

In particular, it is obvious that the two structures 14 could be replaced by a single bow-shaped structure.

What is claimed is:

1. In a wheelchair designed to allow a patient to stand up, and especially for use by a paraplegic patient, comprising a conventional frame resting on the ground by means of forward and backward displacement members and supporting a seat, a backrest, a movable footrest, and a movable structure adapted to occupy the two following positions: a first position, in which the said structure is retracted so as to leave free at least the space at the front of the seat, while maintaining the rolling possibilities of the wheelchair, and, a second position in which the said structure is set in the free space situated in front of the seat while remaining accessible to the hands of the user sitting in the wheelchair and rests on the part of ground situated at the front of the seat, wherein the improvement in said movable structure comprises:

two frames independent of said seat and backrest which extend substantially parallel to the sides of the wheelchair, one frame on each side of said wheelchair, pivot means mounting said independent frames to said conventional frame for pivoting on said conventional frame about horizontal tranverse axes which permit forward pivoting movement of each independent frame over substantially 90°, and a set of bars, for providing forward and rearward support for said patient after standing up, pivotally mounted to said independent frames and initially situated in the first position of the independent frames at the back of said seat, and, in the second position of the independent frames in the free space at the front of said seat.

2. In a wheelchair as claimed in claim 1, wherein in its first position the movable structure occupies the same space volume laterally, on each side of the seat and within the space situated above the seat, which is substantially equal to the space occupied by the frame of a conventional wheelchair.

3. In a wheelchair as claimed in claim 1 or 2, wherein said foot rest can occupy two positions, one corresponding to the rolling possibilities of the wheelchair, in which said footrest is above the ground, without being in contact therewith, and the other in which said footrest is resting firmly on the ground and raises the forward displacement members of the wheelchair, wherein said two independent frames in said second position of the movable structure are adapted to rest on said foot-rest.

4. In a wheelchair as claimed in claim 3, wherein said movable structure further comprises: a locking means to lock the foot-rest in its position resting on the ground.

5. In a wheelchair as claimed in claim 4, wherein said movable structure further comprises: another locking means adapted to lock the two independent frames on the foot-rest in the second position of the structure.

6. In a wheelchair as claimed in claim 5, wherein the movable structure further comprises: a knee-rest which is at least partly removable and which, in the second position of the structure, extends crosswise horizontally, at the level of the knees of a patient using the wheelchair.

7. In a wheelchair as claimed in claim 5, wherein the movable structure has a movable element which, in the second position of said structure, is adapted to be placed crosswise horizontally, substantially close to the vertical plane traversing the front edge of the seat, while being situated at a height which is at least equal to that of the pelvis of a patient standing and which is separate from the seat of said wheelchair.

8. In a wheelchair as claimed in claim 1, wherein in the second position of the structure, the two independent frames are joined together by a dismountable rigid element which, in that second position, is placed transversely and horizontally and ensures the rigidification of said movable structure.

9. In a wheelchair as claimed in claim 8, wherein the said rigid element, in the second position of the movable structure, extends substantially level with the trunk of a patient sitting in the chair.

* * * * *